US006321634B1

(12) United States Patent
Yeo et al.

(10) Patent No.: US 6,321,634 B1
(45) Date of Patent: Nov. 27, 2001

(54) EQUALIZER

(75) Inventors: Harold Yeo, Waterloo; Jack Nobre, Toronto; Christiaan Stolk, Brampton, all of (CA)

(73) Assignee: Wheeltronic Ltd., Mississauga (CA)

( * ) Notice: Subject to any disclaimer, the term of this patent is extended or adjusted under 35 U.S.C. 154(b) by 0 days.

(21) Appl. No.: 09/476,364

(22) Filed: Jan. 3, 2000

(30) Foreign Application Priority Data

Nov. 15, 1999 (CA) ..... 2290117

(51) Int. Cl.[7] ..... F15B 11/00; F15B 13/044
(52) U.S. Cl. ..... 91/515; 91/459
(58) Field of Search ..... 91/511, 514, 515, 91/516, 517, 459

(56) References Cited

U.S. PATENT DOCUMENTS 4,023,650 * 5/1977 Pleier ..... 91/517 X
4,187,763 * 2/1980 Nanda ..... 91/514 X
5,012,898 * 5/1991 Tsymberov ..... 91/515 X
5,072,584 * 12/1991 Mauch et al. ..... 91/437 X
5,076,380 * 12/1991 Tanabe et al. ..... 91/523 X
5,783,755 7/1998 Bruns .
5,800,000 9/1998 Shockley .
5,824,963 10/1998 Bruns et al. .
5,833,260 11/1998 York .
6,189,432 * 2/2001 Colarelli et al. ..... 91/515 X

FOREIGN PATENT DOCUMENTS

1373911 A1 * 2/1988 (RU) ..... 91/511

* cited by examiner

*Primary Examiner*—John E. Ryznic
(74) *Attorney, Agent, or Firm*—Eugene J. A. Gierczak

(57) ABSTRACT

Apparatus for equalizing pressure between two conduits including means for sensing pressure in said conduits; valve means communicating between said conduits, said valve means adapted to open so as to equalize pressure between said conduits.

19 Claims, 10 Drawing Sheets

EQUALIZER

FIELD OF INVENTION

This invention relates generally to a method and apparatus for controlling the movement of a vehicle lift and particularly relates to the uniform movement of the support platform supporting the vehicle in a vehicle lift. More specifically this invention relates to the method and apparatus of utilizing circuitry including an equalizing valve to monitor and control the lifting characteristics of a vehicle lift.

BACKGROUND ART

Hydraulic vehicle lifts are available in a variety of forms including two post, four posts, inground, parallelogram, scissor and portable type.

Generally speaking such vehicle lifts move from a first ground contacting position to a second raised position whereby a vehicle driven unto the lift may be raised from the ground to a raised position permitting wheel alignment, oil change, and other work to be conducted on the vehicle.

Such vehicle lifts generally include a pair of spaced-apart support platforms or rails for supporting the wheels or frame of a vehicle. These support platforms are adapted to be moved by hydraulic cylinders which raise and lower the support platforms as stated. Some vehicle lifts include one cylinder while others may include two cylinders where one of said cylinders is adapted to move one of the support platforms and the other cylinder is adapted to move the other support platform.

Accordingly when using a pair of hydraulic cylinders to move one pair of spaced-apart platforms, it is necessary that the cylinders with the support platforms move in a uniform fashion. If one of the support platforms does not move in unison with the other, a dangerous situation can occur whereby one of the support platforms or tracks is either higher or lower than the other which can cause the vehicle to fall off the lift from a raised position and produce damage to the car and potential hazard to any individuals in the vicinity.

Accordingly various attempts have heretofore been made in the prior art in order to equalize the ascent and descent of the first and second cylinder which moves a first and second vehicle support. Such prior art devices include manually operated circuitry which must be manually operated in order to attempt to adjust the hydraulic cylinders and therefore the height levels of the vehicle supports. However, manual adjustment is prone to error and if the wrong buttons are pushed may actually worsen the situation.

Other prior art devices are shown for example in U.S. Pat. No. 5,833,260 which includes a gyro leveling sensor mounted between and below the level of the support tracks with data transmitted to an assembly of display lights which indicate a high portion of the unit. The unit may then be leveled by initiating hydraulic pressure or release of pressure on one of the link support hydraulic cylinders disclosed therewith.

Another equalizing system is shown in U.S. Pat. No. 5,783,755 which illustrates a lifting device that has a carriage supported by a chain which passes over a sprocket-wheel disposed to rotate about an axis and includes an equalizer system that reduces variations in the measurement, by a load cell, of a load supported by the carriage.

Another arrangement is shown in U.S. Pat. No. 5,800,000 which provides a load adjusting device for use with a lifting unit where the device includes a load spreader or spreader bar supported from a single lift point lift.

Such prior art devices as well as others utilized in vehicle lifts are relatively complicated.

It is an object of this invention to provide an improved method and apparatus for monitoring and controlling the uniform movement of the support platforms in a vehicle lift.

DISCLOSURE OF INVENTION

It is an aspect of this invention to provide an apparatus for equalizing pressure between two conduits including means for sensing pressure in said conduits; valve means communicating between said conduits, said valve means adapted to open so as to equalize pressure between said conduits.

It is a further aspect of this invention to provide electrical circuitry for controlling the pressure of fluid in two conduits comprising sensors means associated with said conduits so as to generate a signal in response to the pressure of a fluid in said conduits; relay means associated with said conduit means so as to control fluid passage through said conduits; adjustable relay means associated with said relay means so as to permit equalization of pressure of said fluid in said conduits.

Yet another aspect of this invention provides a method of equalizing pressure of fluid between a first and second conduit comprising sensing the pressure of fluid in each of said conduits; activating an equalizing valve when one of said sensors senses that the pressure of the fluid has dropped below a preselected level.

It is yet another aspect of this invention to provide a method of controlling the uniform movement of two support platforms of a vehicle lift comprising activating a first and second hydraulic cylinder so as to move first and second support platforms; sensing the pressure of fluid to said first and second cylinders; activating electrical circuitry when said sensing means senses the pressure fluid at a preselected level; stopping said movement of said cylinders when said preselected level has been sensed by said sensors; raising said first and second platforms for a preselected time duration; lowering said first and second platforms so as to activate an equalizing valve to equalize the pressure in said first and second conduits; wherein said flow of fluid in said conduits controlled by said first and second valve means.

BEST MODE FOR CARRYING OUT THE INVENTION

Figure 1:
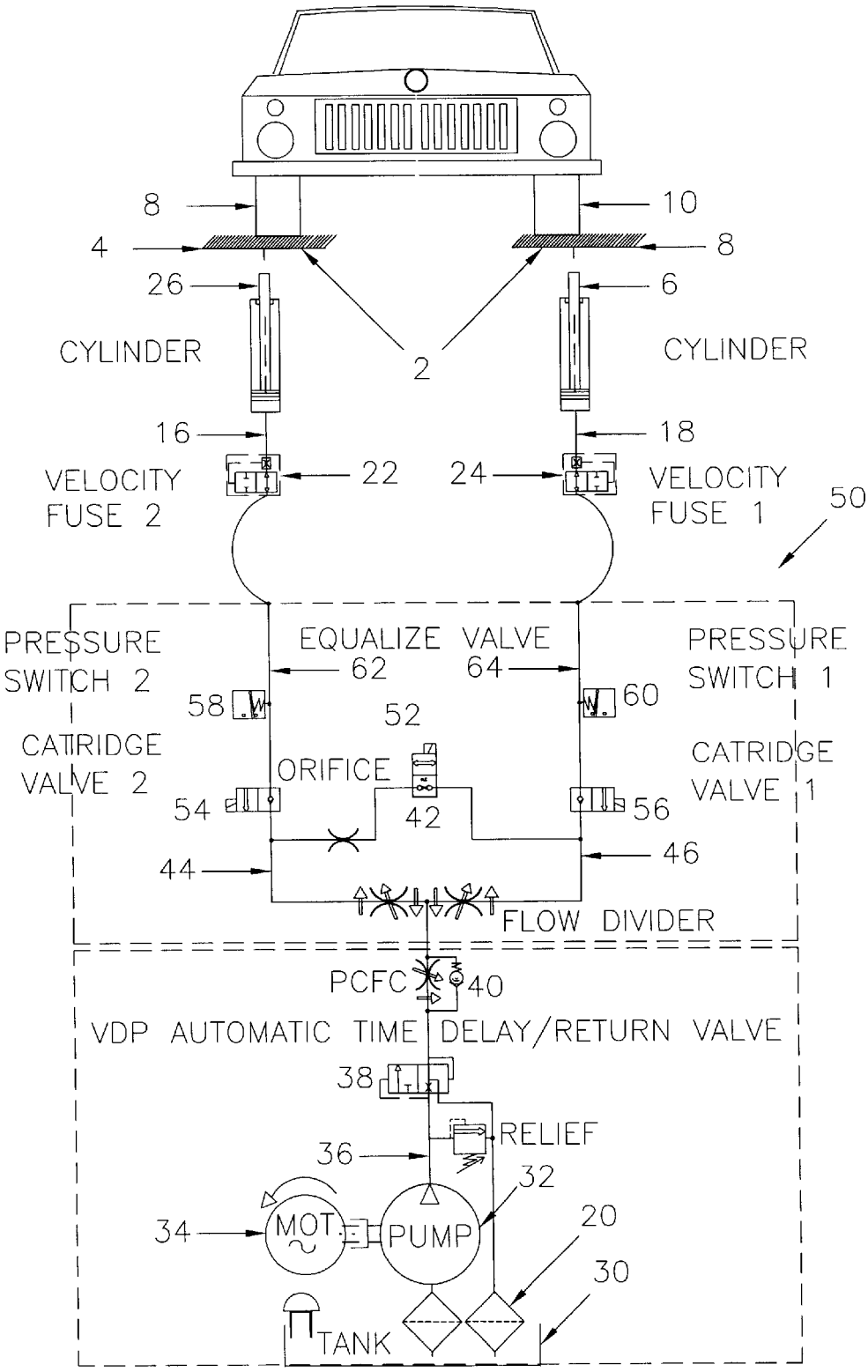
FIG. 1 is a hydraulic schematic diagram of the invention.

In the description which follows, like parts are marked throughout the specification and the drawings with the same respective reference numerals. The drawings are not necessarily to scale and in some instances proportions may have been exaggerated in order to more clearly depict certain features of the invention.

FIG. 1 generally illustrates a hydraulic schematic drawing of the invention to be described herein.

In particular, FIG. 1 teaches a vehicle lift 2 which may either be of a two post, four post, scissor, parallelogram type or the like which includes a first support platform or track 4 spaced apart from a second support platform or track 6 adapted to contact the wheels 8 of a vehicle 10 that is to be raised from a first position whereby the tracks 4 and 6 are in close contact with the ground so as to permit the vehicle 10 to be driven unto the platforms 4 and 6 to a second raised position where the vehicle 10 is raised from the ground as generally shown in FIG. 1.

The vehicle lift 2 includes two cylinders such as hydraulic cylinder 12 and hydraulic cylinder 14. Hydraulic cylinder 12 is adapted to raise the vehicle support platform 4 from the first to second position as described earlier while hydraulic cylinder 14 is also adapted to raise and lower the vehicle support 6 from the first to second position as described above.

The cylinders 12 and 14 are connected by appropriate separate conduits 16 and 18 to a source of fluid 20 which will be more fully particularized herein.

Each of the cylinders 12 and 14 have associated therewith in line with the conduits 16 and 18 respectively, velocity fuses 22 and 24 as illustrated in FIG. 1. The velocity fuses 22 and 24 operate in a manner well known to those persons skilled in the art. Generally speaking hydraulic fluid is pumped into the cylinders 12 and 14 so as to activate the pistons 26 and 28 to move the support platforms 4 and 6 to raise the vehicle 10 from a first lowered position to a second raised position. If there is a condition whereby fluid rushes out of the cylinders 12 and 14 at a rate higher than a preselected level the velocity fuses 22 or 24 or both will be activated so as to shut down the release of fluid in a manner well known to those persons skilled in the art.

For example if the conduits 16 and 18 are automatically cut or other emergency situation arises the velocity fuses 22 or 24 or both will be activated to prevent the release of fluid thereby preventing the vehicle 10 from crashing down towards the ground.

The fluid 20 is contained in a tank 30 and is adapted to be pumped by means of a pump 32 connected to a motor 34 so as to pump the fluid through conduit 36 past the automatic time delay/return valve 38 towards the pressure compensated flow control cartridge 40 towards the flow divider 42 that divides the fluid 20 flow towards conduit 44 which communicates with cylinder 12 and conduit 46 which communicates with cylinder 14. The flow divider 42 is available in the industry and generally divides the flow of fluid when raising the lift and combines the fluid when lowering the lift.

Figure 2:
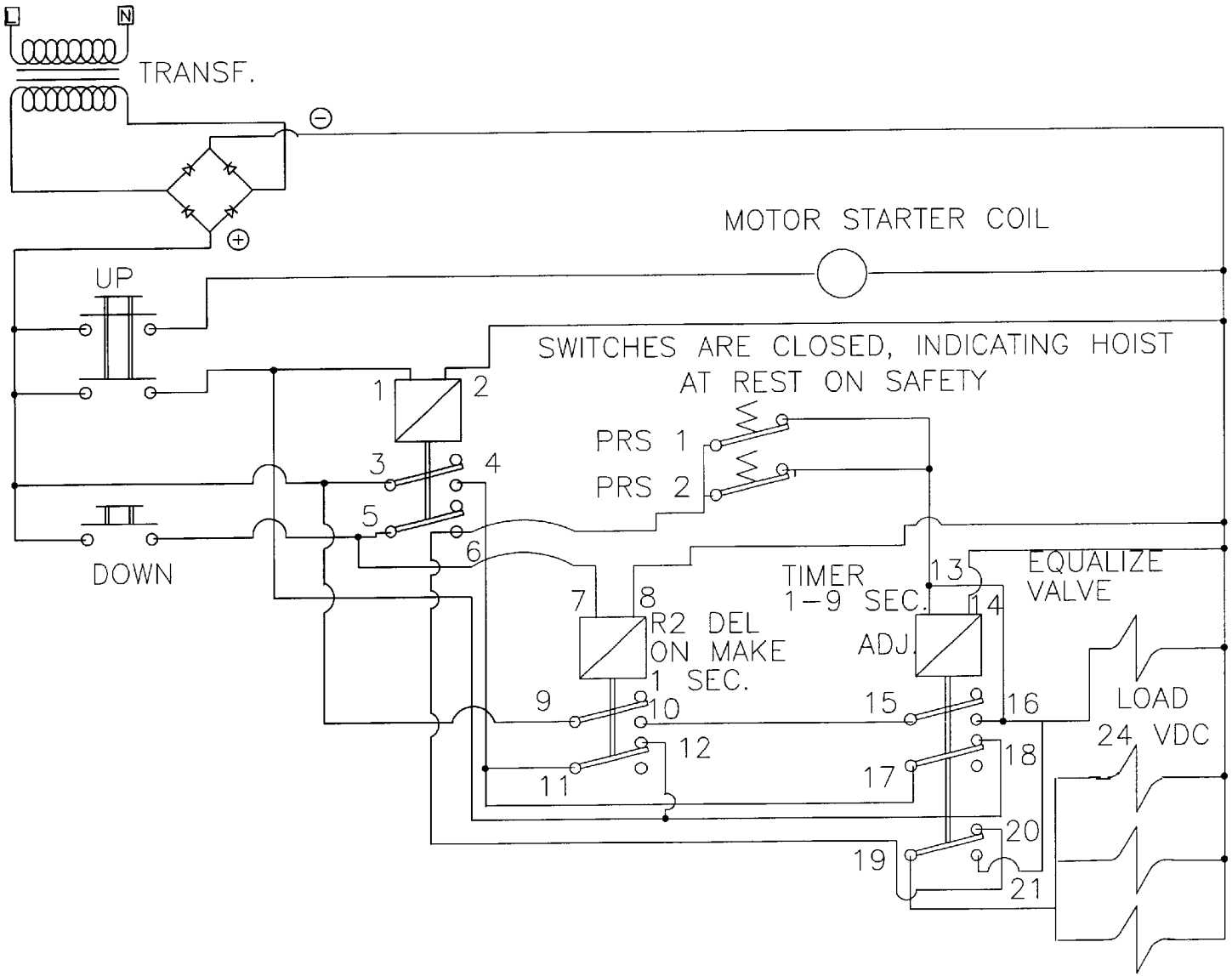
FIG. 2 is an electrical schematic diagram of the invention.
Figure 3:
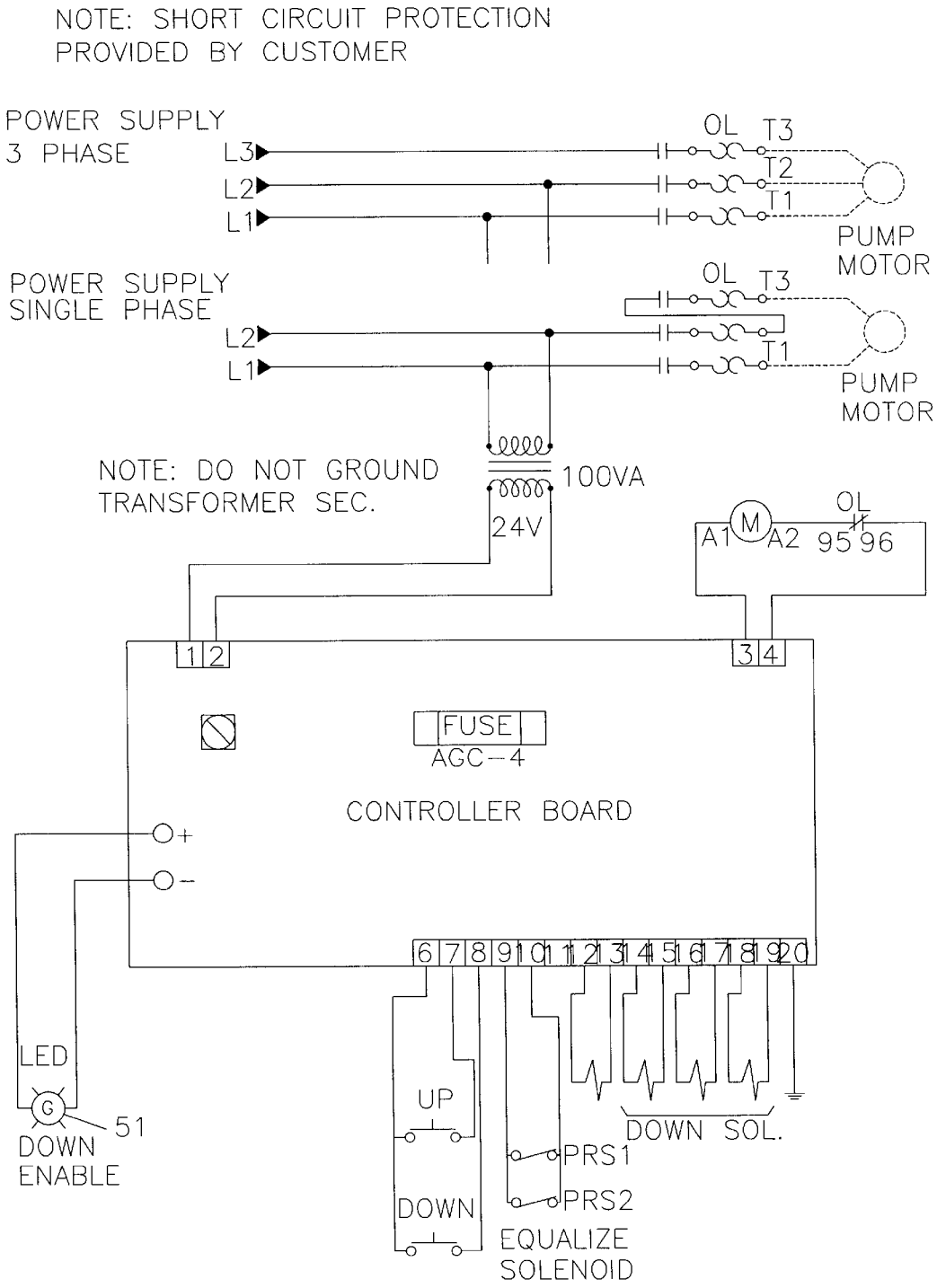
FIG. 3 is a schematic connecting diagram.

The hydraulic schematic shown in FIG. 1 include means to equalize generally indicated as 50 in FIG. 1. Such means to equalize 50 includes an equalizing valve 52 disposed between a first and second valve 54 and 56. The circuitry for monitoring and controlling such equalizing means are illustrated in FIGS. 2 and 3 which shall be more fully particularized herein.

The equalizing means 50 to be described herein is an improvement over the manual push button means for equalizing the cycling (up and down motion) of an lift previously described. Such equalizing means is activated substantially automatically through the use of two pressure switches 58 and 60 and the circuitry described in FIG. 2.

The pressure switches 58 and 60 are installed in conduits 62 and 64. Conduits 62 communicates with conduits 44 and 16 while conduit 64 communicates with conduits 46 and 18. In particular the pressure switches 58 and 60 are installed in each of the pressure lines or conduits 62 and 64. Each of the pressure sensors 58 or 60 or both will generate a signal when the pressure in one or both of the conduits 62 or 64 reach a level below a selected level such as for example under 150 pounds per square inch.

Generally speaking the equalizing means 50 will generally permit equalizing of the pressure of fluid in cylinders 12 and 14 by activating the circuitry so as to open the equalizing valve 52, and communicates with valves 54 and 56 so as to permit the fluid pressures to reach the same pressure. Valves are available in the prior art which combines the function of valves 54 and 56 in one multi-ported valve activated by one signal and operated by one coil.

Prior art devices using manual systems left the chance of an operator to push a manual equalizing valve in error which would magnify and worsen the position of the vehicle to a point where the vehicle could fall off the lift.

The equalizing means 50 performs its function in the descending mode only.

Hydraulic lifts 2 are generally installed with safety locking mechanisms which comprise of one locking bars associated with cylinder 12 and a second locking bar associated with cylinder 14. Such locking mechanisms are generally well known to those persons skilled in the art one such example being shown in U.S. Pat. No. 5,322,143.

Figure 4:
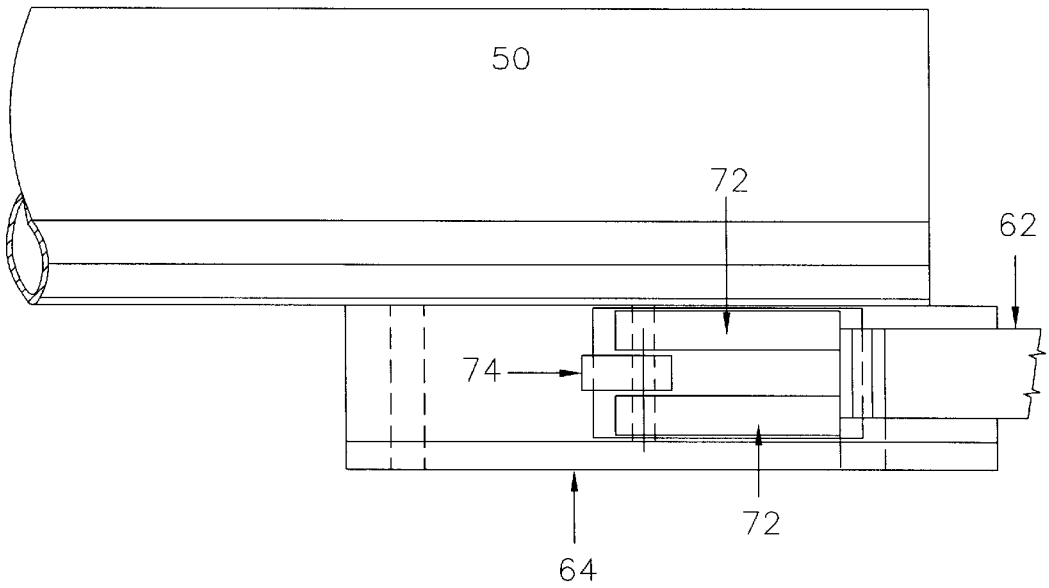
FIG. 4 is a top plan view of a safety mechanism.

One such locking mechanism is shown in FIGS. 4 and 5 herein where the locking bar 62 also includes a U-shaped bracket 64 which may be welded to the side of the cylinders 12 and 14. On the bottom of the generally flat bracket 64 there is a rectangular stop member 68.

The free end of the locking bar 62 is provided with an inclined abutment face 70 on the top of the locking bar 62 a pair of rectangular elements 72 are welded in a cam 74 pivotally mounted therebetween.

Figure 5A:
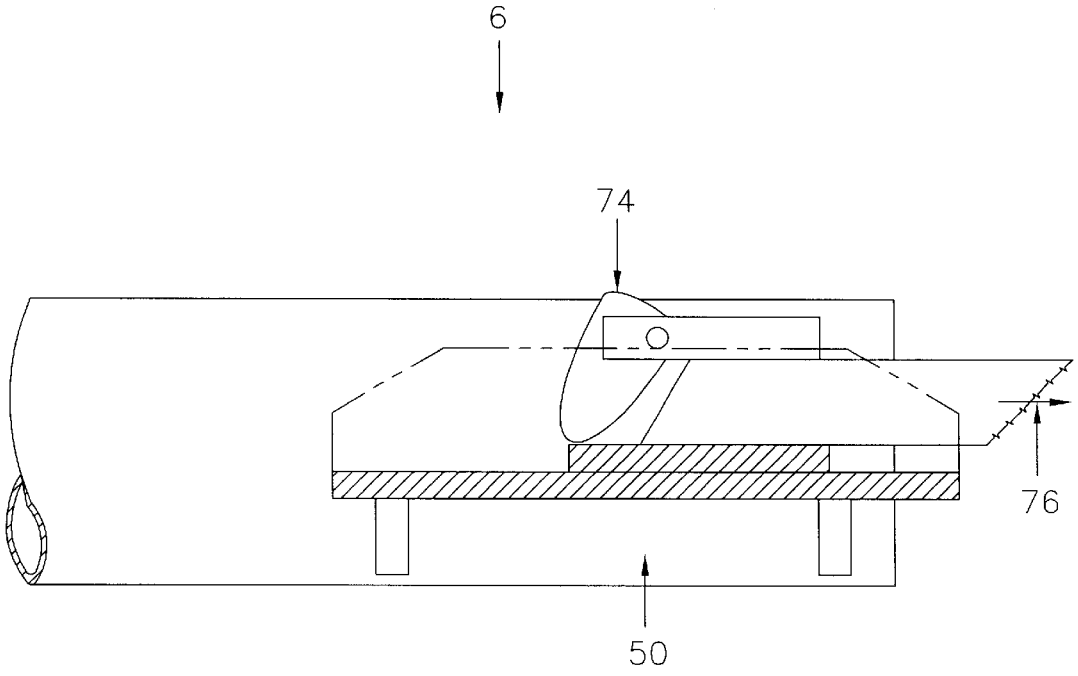
FIGS. 5*a* to 5*f* are side views of a locking mechanism.

In use when the lift is raised the locking bar 62 slides through the U-shaped brackets 64. The locking bar 62 slidably moves relative the stop member 68 and the cam 74 freely pivots out of the way as indicated in FIG. 5*a*.

Figure 5B:
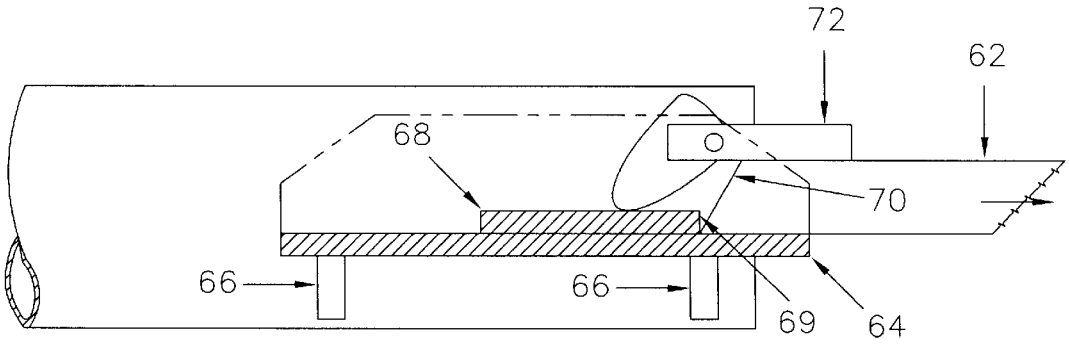

When the lift approaches a raised position locking bar 62 drops off the end of the rectangular stop 68 as shown in FIG. 5*b*. As the bar 62 drops down, this provides an audible sound to the user. This then locks the lift in the raised position and prevents it from collapsing even in the event of a major severance of the hydraulic supply lines as shown in FIG. 5*b*. A plurality of stops 68 may be included as the cylinders 12 and 14 are extended on he bracket 64.

Figure 5C:
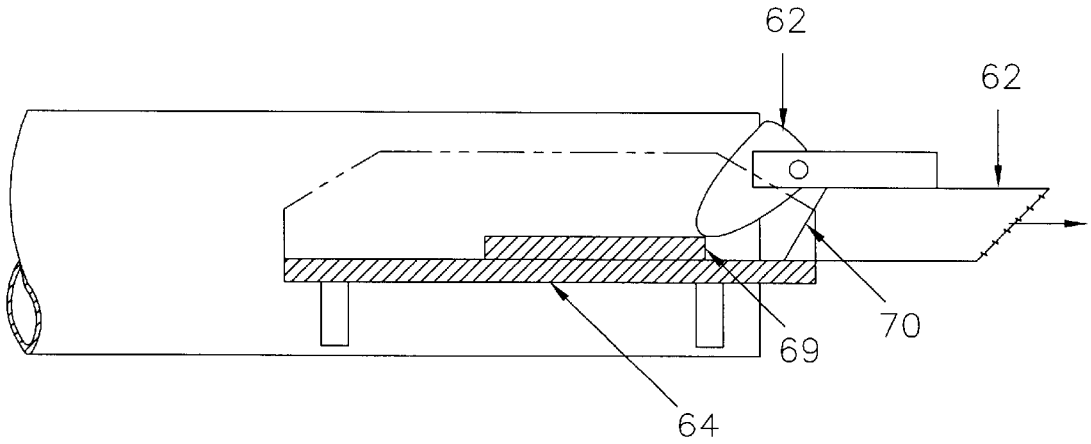

To lower the lift 2, the lift is first raised further from its locked position as shown in FIG. 5*c* and the locking bar 62 is then pulled further away from rectangular stop 68. Then as shown in FIGS. 5*c* and 5*d* this enables the cam 74 to drop down off the top of the rectangular stop 68 and the cam 74 is pivotally mounted adjacent one side so that its center of gravity will below the pivot point in the configuration shown in FIG. 5*d*.

Figure 5D:
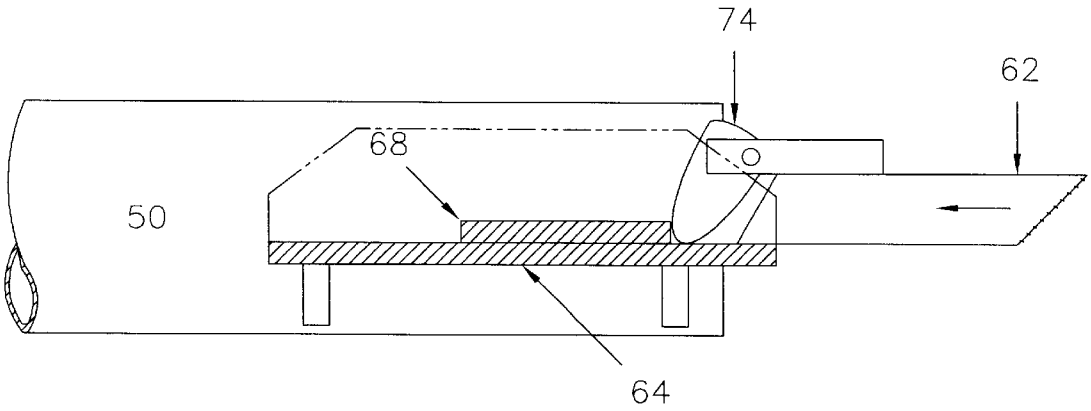
Figure 5E:
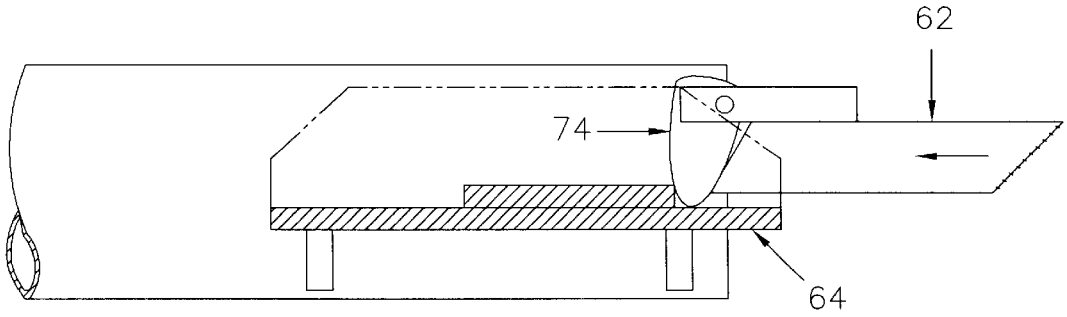
Figure 5F:
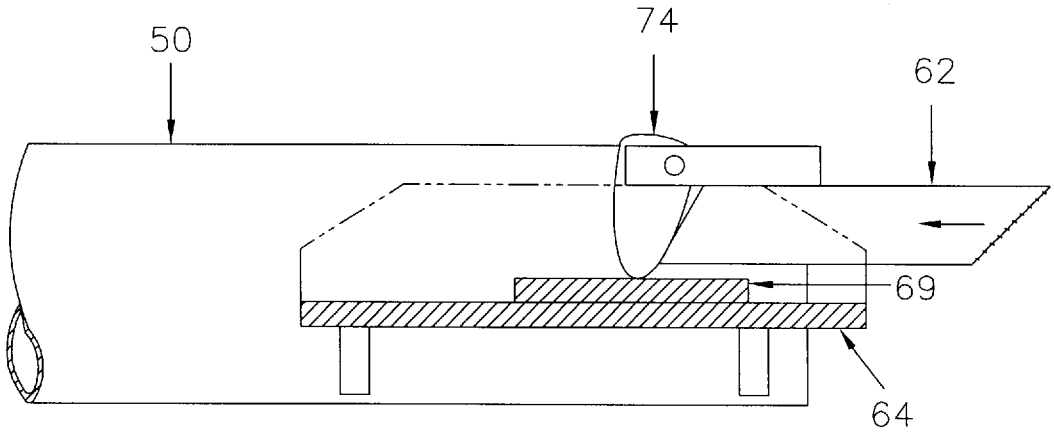

When the lift 2 is lowered as shown in FIGS. 5*d* and 5*e*, the hydraulic cylinder 50 is caused to retract and the locking bar then travels downwardly which causes the cam 74 to be pivoted until it comes into abutment with the abutment face 70 as shown in FIG. 5*e*. This then presents an inclined cam surface to the stop face 69 inclined at an acute angel to the top surface of the stop member 68 which causes the cam 74 and therefore the locking bar 62 to ride up on top of the rectangular stop 68. With the locking bar 62 on top of the stop 68, the lift can then be freely lowered to its fully collapsed or lowered configuration.

The locking mechanism shown in FIGS. 5*a*, 5*b*, 5*c*, 5*d*, 5*e* and 5*f* as well as FIG. 4 shows one example of a locking bar mechanism although others can be used in accordance with the invention to be fully described herein so long as each independent cylinder 12 and 14 each have one locking bar 62 or the like.

Accordingly the equalizing means 50 operates such that once one side 4 or the other side 6 of the lift 2 meets the safety position on the safety bar 62 or reaches ground level, this will enable the equalizing means 50 to open up the equalizing valve 52 allowing the other side of the lift 6 to level itself with the first side 4.

When the equalizing means 50 is activated on an vertical level other than on ground level the safety equalizing means 50 will prevent the lift 2 from coming down even if one side 4 or 6 misses a safety position on the safety bar 62 thus preventing one side 4 or 6 to continue to descend and creating the possibility of a vehicle falling off.

Moreover if a safety position is missed on other one of the safety bar 62 the lift 2 is stopped automatically as it will be clear that the vehicle 10 will be in a position at a slight angle when shown in FIG. 1 and thus must be corrected.

With the equalizing means 50 the operator must first raise the lift 2 until an indicator light 51 is activated which is located on the console of the circuitry shown in FIG. 2 which indicates that the operator is permitted to lower the lift 2 once again.

Accordingly when the operator first has to raise the lift 2 the lift 2 will be raised a short distance so as lift both sides 6 or 4 up so as to permit the side which has missed the safety, up far enough now to land on the safety position on the bar 62 when the lift is lowered again.

The equalizing means 50 will perform this function and the lift 2 will be automatically levelled on the two safety positions.

Accordingly the equalizing means 50 minimizes operator errors and simplifies the operation of the lift 2 while adding an important safety feature.

As shown in FIGS. 2 and 3 the method operates on a 24 volt direct current thus making the push buttons UP and DOWN as shown in FIG. 2 and the associated electrical wires less dangerous than when utilizing a higher voltage system such as 220 volts alternating current or the like. In other words, if a 24 volt direct current is cut or accidentally exposed this creates a less hazardous position than if the same situation occurred with a 220 volt alternating current.

The circuit board as shown in FIGS. 2 and 3 illustrate three relays namely R1, R2 and an adjustable relay. In particular R1 is activated by electrical wires 1 and 2 as shown in FIG. 2 while Relay 2 is activated by electrical wires 7 and 8 shown in FIG. 2 with an adjustable relay activated by electrical wires 13 and 14 as shown in FIG. 2. The adjustable relay as shown in FIG. 2 is adjustable in time between one and nine seconds for the auto equalizing timing to be described herein. Each of the relays R1, R2 and adjustable relay including a coil in a manner well known to those skilled in the art. Moreover the adjustable relay can be adjusted by turning a dial for example to one side so as to activate the relay after the duration of one second or if adjusted in the opposite direction to be activated for example after a nine second delay.

The components of the equalizing means can be adjusted to any suitable parameters but in the example shown in FIGS. 2 and 3 (as shown by example only and not be limited thereto) lift 2 must be raised for a minimum of two seconds in order to set the system and permit lowering to be possible.

The green light 51 described earlier indicates when the lift can be lowered. The transformer shown in FIG. 2 has a secondary output of 100 VA at 24 volts. One will also see from FIG. 2 that the motor starter signal is integrated to the circuit board and not operated directly from the push button pendants.

The high pressure flow divider shown in FIG. 1 also includes therewith pressure switches which will have no function once the equalizing means 50 has been activated. Moreover all valve coils shown in FIG. 2 are operated on 24 volts DC. Furthermore the circuit board as shown integrates electronics and relays and can not generally be changed in the field.

Setting The Equalization Time

The equalizing time can be adjusted between one and nine seconds. In particular one can set the equalizing time by the following procedure:

(i) raise the lift 2 above the lowest safety position for both of the safety bar 62 located on side 4 and 6;

(ii) thereafter disable one of the safety bars 62 either on the side 4 or 6;

(iii) lower the lift by pressing the down button as shown in FIG. 2;

(iv) once the non-disabled safety 62 catches for example on side 4 the other side 6 will continue to be lowered as the safety has been disengaged;

(v) the adjustable relay as shown in FIG. 2 has associated therewith an adjustable potentiometer on the circuit board which regulates the time of lowering. This time should be adjusted between one and nine seconds in such a way that the lowering sides of the lift which is disabled will stop slightly past the locked safety side 4 of the safety bar 62;

(vi) the adjustment on the potentiometer can be made at any time but it is recommended to leave the standard setting set in place to avoid any misfortunes or accidents in the field;

(vii) all of the other delay functions such as for example in relay R1 and relay R2 are not field adjustable if different time rates need to be selected as this can be done at the manufacturers level.

In one example the pressure switches 54 and 56 which have been identified as PRS1 and PRS2 in FIG. 2 are wired-in parallel into the circuit board. As shown in FIG. 3 the pressure switches 54 and 56 are wired-in parallel in positions 8 and 9.

The equalizing means 50 as shown in FIGS. 2 and 3 include three coils but the equalizing means can include a plurality of coils such as four or the like. Furthermore one may use two coils, if 54 and 56 are combined and operate of one coil.

Moreover as shown in FIG. 1, a pressure compensated flow control cartridge PCFC is installed in the main body to allow smooth descent of the lift.

By viewing FIG. 1, one will notice that there is no check valve in the system due to the automatic switching valve. Furthermore the relief valve 70 is fully adjustable. Moreover if for some reason there is a failure of one of the electrical coils shown in FIG. 2, the system will not descend (or there will be a very slow descent on one side only) or not equalize.

FIG. 2 is a functional view of the circuit board while the connecting diagram of FIG. 3 shows only connections and locations of the equalizing adjustment.

Operation

By viewing FIGS. 1 and 2 one can see that upon activating the up button the motor starter coil is activated causing hydraulic fluid 20 to move cylinders 12 and 14 thereby lifting the vehicle 10 to a raised position. Once the vehicle 10 is raised uniformly upwardly to a desired position the cylinders 12 and 14 are further raised so as to engage the stops in the safety bars 62 by lowering the vehicle slightly in a manner well known to those skilled in the art. Thereafter an operator will work on the automobile and once finished will then lower the vehicle on the lift 2 by first pressing the up button so as to raise the vehicle 10 upwardly so as to disengage the stops on the stop bar 62 and thereafter the down button is pressed as shown in FIG. 2 so as to open the cartridge valves 54 and 56 to permit fluid to flow past the flow divider and back into the tank 30.

In particular by pressing the up button for a selected period of time between one and three seconds the relay R1 will be energized and hold itself electrically after the selected period of time. Energization of relay R1 makes electrical contact between points 3–4 and between points 5–6. Relay R1 will be latched through electrical contact between points 3–4–11–12–1 or between points 34–17–18–1 if the up button is pressed for the selected time period between one and three seconds. At this time the up button can be released and relay R1 will be held energized until electrical contact between points 11–12 and between 17–18 are broken. Furthermore electrical contact between points 5–6 will energize the cartridge valves 54 and 56 solenoid coils through points 5–6–20–19 upon pressing the down button.

By pressing the down button for one second the relay R2 will be energized and stay energized as long as the down button is held. Energization of relay R2 makes electrical contact between points 9–10 and between points 11–12. When lift 2 is lowered in a normal down descent whereby pressure in the conduits is higher than a set pressure (such as for example 150 pounds per square inch) both pressure switches PRS 1 (60) and PRS 2 (58) will be in the open position namely not making contact. In FIG. 2 both pressure switches are shown closed representing the position of the switches when the lift 2 is at rest on the ground or on safeties.

More specifically when the down button is pressed in a normal down descent the circuit is completed between 5–6 as previously staged by pressing the up button and unto the two cartridge valves 54 and 56 so as to continue descent of the vehicle.

If however, there is an obstruction upon descending of the vehicle 10 (such as for example the safety on side 4 catches while on side 6 the safety does not catch) then the pressure in the conduit associated with the obstructed side (4) will be lower than the preselected pressure. This low pressure closes the pressure switch PRS 2 (58) associated with the stopped side (4) thereby energizing adjustable timer relay through points 5–6-PRS 2 (58)–13 and energizing the equalizing vavle 52 solenoid through points 15–16. The unobstructed side (6) will only continue to descend for the preset time one to nine seconds that the adjustable timer relay remains energized for once the above circuit is closed or until side 6) catches a safety or lands on the ground. After adjustable timer relay times out relay R1 will be de-energized as electrical connection between 17–18 is broken. Thereafter the lift will stop descending and generally speaking one side may still be higher than the other side.

Accordingly the up button must now again be energized to lift the vehicle 10 such that both cylinders 12 and 14 are raised with the equalizing means 50 the operator must first raise the lift 2 until and indicator light 51 is activated. Safety stop 62 which is not caught on side 6 is raised along with the other safety stop 62 such that both stops 62 on side 4 and 6 are found between safety positions. Thereafter by pressing the down button both sides 4 and 6 descend until side 6 catches the safety and stops and then, since side 6 stops, a signal is sent by PRS1 since the pressure drops below 150, and than the equalizing valve opens for a preselected time (since this side was lower in height than side 4) while side 4 will continue to drop until its safety catches or the timer on the equalizer valve runs out—in which one must repeat the steps of lifting for reset. The relay on adjustable relay is generally adjusted at approximately two seconds so that the vehicle 10 does not continue to be lowered in a more unbalanced position. It will be seen from FIG. 2 that adjustable relay does not get power on contact 13 until one of the pressure switches 58 and 60 activates the closed circuit. So as to make power to contact 5. Accordingly the equalizing valve can only be powered by first pressing the up button which energizes R1 then creates the possibility of powering the equalizing valve by pressing the down button since contacts 5 and 6 are made and then only if PRS1 or PRS2 are activated.

The components of the equalizing means can be adjusted to any suitable parameters but in the example shown in FIGS. 2 and 3 (which were shown by example only and not to be limited thereto) the lift 2 can be raised for approximately two seconds in order to set the system and lowering is possible.

Various embodiments of the invention have now been described in detail. Since changes in and/or additions to the above-described best mode may be made without departing from the nature, spirit or scope of the invention, the invention is not to be limited to said details. For example the adjustable relay can be replaced by a preselected (non-adjustable) time relay.

Although the preferred embodiment as well as the operation and use have been specifically described in relation to the drawings, it should be understood that variations in the preferred embodiment could be achieved by a person skilled in the trade without departing from the spirit of the invention as claimed herein.

We claim:

1. Apparatus for equalizing pressure between two conduits including:

(a) means for sensing pressure in said conduits;

(b) valve means communicating between said conduits, said valve means adapted to open so as to equalize pressure between said conduits.

2. Apparatus as claimed in claim 1 including a first valve associated with one of said conduits and a second valve associated with said other conduit, wherein said valves permit passage of said fluid to said conduits, said equalizing valve means disposed between said first and second valve.

3. Apparatus as claimed in claim 2 wherein said sensing means comprises:

(a) first pressure sensor associated with said first conduit;

(b) second pressure sensors associated with said second conduit.

4. Apparatus as claimed in claim 3 wherein said first and second valves permits the passage of said fluid in a first direction and is adapted to be activated to permit passage of said fluid in an opposite direction.

5. Apparatus as claimed in claim 4 wherein said equalizing valve means communicates with said first and second valves.

6. Apparatus as claimed in claim 5 further including an adjustable relay that activates said equalizing valve.

7. Apparatus as claimed in claim 6 wherein said relay is adapted to be adjusted to activate said equalizing valve between one and nine seconds.

8. Apparatus as claimed in claim 7 wherein said first valve, said second valve and equalizing valve are activated by electrical means.

9. Electrical circuitry for controlling the equalization of pressure of fluid in two conduits comprising:

(a) sensors means associated with said conduits so as to generate a signal in response to the pressure of a fluid in said conduits;

(b) relay means associated with said conduit means so as to control fluid passage through said conduits;

(c) adjustable relay means associated with said relay means so as to permit equalization of pressure of said fluid in said conduits.

10. Electrical circuitry as claimed in claim 9 wherein said relay equalizing means includes adjustable relay means so as to adjust the duration of said communication with said equalizing means and said first and second conduits.

11. Electrical circuitry means as claimed in claim 10 further including pressure sensor means associated with said first and second conduits so as to energize said adjustable relay means.

12. Electrical circuit as claimed in claim 10 including a first contact switch so as permit fluid flow in a first direction and for energizing a first relay.

13. Electrical circuitry as claimed in claim 11 including a second contact for energizing a second relay once a first relay has been energized.

14. A method of equalizing pressure of fluid between a first and second conduit comprising;

(a) sensing the pressure of fluid in each of said conduits;

(b) activating an equalizing valve when one of said sensors senses that the pressure of the fluid has dropped below a preselected level.

15. A method as claimed in claim 14 further including activating said equalizing valve by electrical means.

16. A method of controlling the uniform movement of two support platforms of a vehicle lift comprising:

(a) activating a first and second hydraulic cylinder so as to move first and second support platforms;

(b) sensing the pressure of fluid to said first and second cylinders;

(c) activating electrical circuitry when said sensing means senses the pressure of the fluid at a preselected level;

(d) stopping said movement of said cylinders when said preselected level has been sensed by said sensors;

(e) raising said first and second platforms for a preselected time duration;

(f) lowering said first and second platforms so as to activate an equalizing valve to equalize the pressure in said first and second conduits;

(g) wherein said flow of fluid in said conduits is controlled by said first and second valve means.

17. A method as claimed in claim 16 further controlling said valve means by electrical relay means.

18. A method as claimed in claim 17 further including controlling said equalizing valve by adjustable relay means.

19. A method as claimed in claim 18 wherein said adjustable relay means can be adjusted to activate said equalizing valve between one and nine seconds.

* * * * *